US007757531B2

(12) United States Patent
Klöckner et al.

(10) Patent No.: US 7,757,531 B2
(45) Date of Patent: Jul. 20, 2010

(54) CONVEX ROLL USED FOR INFLUENCING THE PROFILE AND FLATNESS OF A MILLED STRIP

(75) Inventors: Jürgen Klöckner, Netphen-Eschenbach (DE); Thorsten Bode, Neuss (DE); Ludwig Weingarten, Düsseldorf (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 31 days.

(21) Appl. No.: 11/596,935

(22) PCT Filed: Sep. 9, 2005

(86) PCT No.: PCT/EP2005/009717

§ 371 (c)(1),
(2), (4) Date: Nov. 17, 2006

(87) PCT Pub. No.: WO2006/029770

PCT Pub. Date: Mar. 23, 2006

(65) Prior Publication Data

US 2008/0000281 A1 Jan. 3, 2008

(30) Foreign Application Priority Data

Sep. 14, 2004 (DE) ..... 10 2004 044 903

(51) Int. Cl.
*B21B 13/14* (2006.01)
*B21B 39/20* (2006.01)

(52) U.S. Cl. ..... 72/252.5; 492/1; 72/247; 72/241.2

(58) Field of Classification Search ..... 72/252.5, 72/247, 241.2; 492/1
See application file for complete search history.

(56) References Cited

U.S. PATENT DOCUMENTS 4,703,641 A * 11/1987 Yarita et al. ..... 72/247
4,798,074 A 1/1989 Feldmann et al.

(Continued)

FOREIGN PATENT DOCUMENTS

CN 2149986 12/1993

(Continued)

OTHER PUBLICATIONS

Guo R-M: Characteristics of Rolling Mills With Roll Shifting, Pittsburgh, US, vol. 65, No. 12, Dec. 1, 1988, XP 000024573, p. 7.

*Primary Examiner*—Dmitry Suhol
(74) *Attorney, Agent, or Firm*—Friedrich Kueffner

(57) ABSTRACT

Rolling stand for producing rolled strip, which includes work rolls, which are supported on backup rolls or intermediate rolls and backup rolls. The work rolls and/or the backup rolls and/or the intermediate rolls can be axially shifted relative to one another. The barrel length (L) of each intermediate roll in a six-high rolling stand or of each work roll in a four-high rolling stand has a cylindrical roll barrel section (Z) and a convexly curved roll barrel section (R(x)), such that the transition point from the cylindrical to the curved roll barrel section, calculated from the cylindrical end of the roll barrel, is in the range of $L/2 \leqq x < L$. The curved contour, which extends towards opposite ends of the two rolls over a portion of the barrel, is described by a polynomial $R(x)=a_o+\ldots a_n x^n$, where $n \geqq 5$.

6 Claims, 8 Drawing Sheets

U.S. PATENT DOCUMENTS

| | | | | | |
|---|---|---|---|---|---|
| 4,881,396 | A | * | 11/1989 | Seidel et al. | 72/247 |
| 5,174,144 | A | * | 12/1992 | Kajiwara et al. | 72/236 |
| 6,119,500 | A | * | 9/2000 | Ginzburg et al. | 72/247 |

FOREIGN PATENT DOCUMENTS

| | | |
|---|---|---|
| DE | 3624241 | 1/1988 |
| DE | 691 15 746 | 4/2004 |
| EP | 0 294 544 | 12/1988 |
| SU | 1713696 | 2/1992 |
| SU | 1713697 | 2/1992 |

* cited by examiner

CONVEX ROLL USED FOR INFLUENCING THE PROFILE AND FLATNESS OF A MILLED STRIP

The invention concerns a rolling stand for producing rolled strip, which consists of work rolls, which are possibly supported on backup rolls or on intermediate rolls and backup rolls, wherein the work rolls and/or the backup rolls and/or the intermediate rolls can be axially shifted relative to one another.

Rolling mills with pairs of rolls that can be shifted are well known. Each roll of at least one of these pairs of rolls is provided with a curved contour, which runs in the direction of one end of the barrel and extends over a portion of the width of the rolling stock towards opposite sides on the two rolls, wherein the curved contour extends over the entire barrel length of the two rolls and has a form with which the two barrel contours complement each other in a certain relative axial position.

For example, DE 36 24 241 C describes a rolling mill in which each of the work rolls has a curved contour that tapers towards one end of the roll and widens towards the other end of the barrel, and the work rolls are oppositely arranged in the axial direction, so that they can be adjusted in such a way that the tapering end of each work roll or intermediate roll is held between an edge of the rolled product and the end of the associated backup roll and each is preferably aligned with one edge of the rolled product.

Furthermore, EP 0 249 801 B1 discloses a rolling mill for producing rolled strip, in which the rolls are provided with a curved contour that extends essentially over the entire barrel length. The contours of all of the rolls in the initial state or unloaded state are such that the axial course of the sum of the effective roll barrel diameters in each relatively changed axial position of the rolls with respect to one another assumes a course that deviates from a constant course and follows a mathematical function that is symmetric with respect to the center of the roll.

Mathematically, the curved contour of the rolls usually follows a third-order polynomial. On the basis of the shift amounts used in actual practice and the actual bending values on the rolls, a positive and negative adjustment range is almost always obtained for the CVC rolls (CVC=continuously variable crown). The conventional CVC cross section is meaningful here, even when negative CRA values are required (CRA=crown equivalent to the normal camber of a roll).

In the past, negative experiences with respect to roll wear were obtained with the $x^3$ cross section of the CVC rolls in six-high rolling stands. The large diameter difference of the intermediate rolls caused increased wear and rough surfaces on the backup rolls, and the pattern of damage on the backup rolls corresponded to the shape of the CVC cross section after an extended running time. In the case of four-high stands as well, the cross-sectional amplitude was likewise initially significantly greater than necessary for the rolled programs, so that the unfavorable wear pattern on the backup rolls also developed here.

Since, on the basis of the shift amounts used in practice and the actual bending values, the negative adjustment range of the CVC cross section was not always necessary in the past, and taking into consideration the negative bending, mainly only positive CVC effects are required, the objective of the invention is to specify a shape of the roll cross section in the purely positive range, with which the aforementioned disadvantages of the $x^3$ cross section of the CVC rolls can also be avoided.

This objective is achieved with the characterizing features of claim 1 in such a way that the roll barrel length L of each intermediate roll in a six-high rolling stand or of each work roll in a four-high rolling stand consists of a cylindrical roll barrel section Z and a convexly curved roll barrel section R(x), such that the transition point A from the cylindrical to the curved roll barrel section can be selected in the range of $L/2 \leqq x < L$ (where x is calculated from the cylindrical end of the barrel), and the curved contour, which extends towards opposite ends of the two rolls over a portion of the width of the rolling stock in the direction of the end of the barrel, is described by a mathematical polynomial $R(x)=a_0+ \ldots a_n x^n$, where $n \geqq 5$.

The use of this type of convex roll with a partially convex contour of the roll barrel, which is ultimately a subset of $CVC^{plus}$, results in a uniform distribution of the contact stresses between the rolls lying one above the other. This is a problem, for example, especially in the case of rolls with an S-shaped cross section (CVC), since this can lead to local stress peaks in the barrel region, which cause increased roll wear and can be prevented only by corresponding compensating cross sections of the rolls lying above.

In accordance with the invention, the rolls, which are provided with a convexly curved roll barrel section, are designed with a roll diameter that is so large that the bending forces have an essentially parabolic ($x^2$) effect on the roll gap profile.

Rolls with conventional $x^3$ CVC cross sections also yield a predominantly parabolic effect, so that, consequently, there is virtually no adjustment mechanism with which higher-order flatness defects can be compensated. This is especially the case for so-called Z-high stands, which, due to the small work roll diameter, are equipped without work roll bending for design reasons. This disadvantage can be prevented by the use, in accordance with the invention, of intermediate rolls or work rolls with a cross section of higher order $x^5+x^6+x^7 \ldots$.

As a result of the feature of the invention that the transition point A from the cylindrical to the curved roll barrel section can be variably selectively adjusted in the range of $L/2 \leqq x < L$, different profile adjustment goals can be realized. If, for example, the transition point A is at $x=L/2$, then predominantly parabolic ($x^2$) flatness defects are combatted, while for a transition point A of $x>L/2$, defects of higher order ($x^4$ and higher) can be compensated to a greater and greater extent.

So that the rolls shaped in accordance with the invention can develop their full effect, the other rolls of the rolling stand besides the convex rolls are designed with a roll barrel that is cylindrical over its entire length.

Additional advantages and details of the invention are explained in greater detail below with reference to the specific embodiments illustrated in the drawings.

Figure 1:
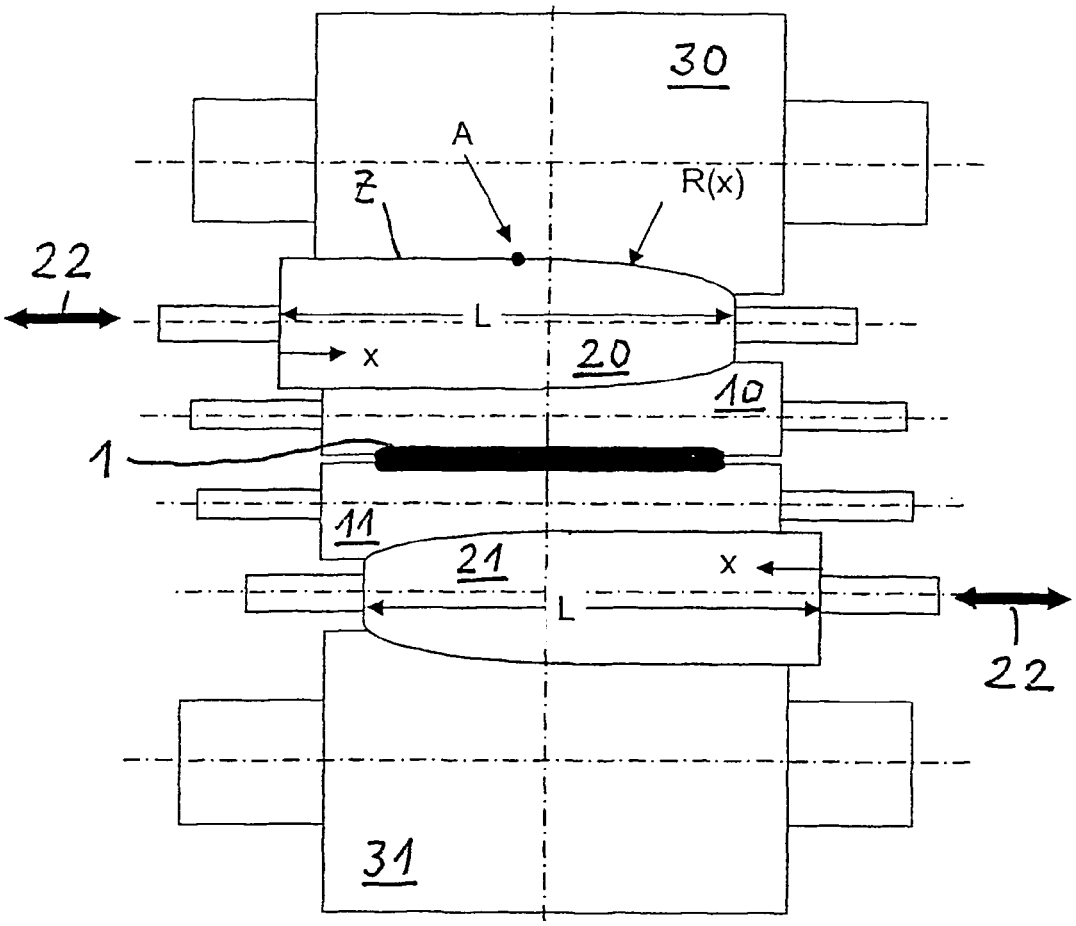
FIG. 1 shows the rolls of a six-high stand with intermediate rolls shaped in accordance with the invention.

FIG. 1 shows a six-high stand for producing rolled strip 1 with work rolls 10, 11, intermediate rolls 20, 21, and backup rolls 30, 31. The work rolls 10, 11 and the backup rolls 30, 31 are cylindrically shaped over their entire barrel length and in the illustrated embodiment cannot be axially shifted, whereas the intermediate rolls 20, 21 are mounted in accordance with the invention to be axially shiftable in arrow direction 22 and are formed with a partially convexly curved roll barrel section R(x). The transition point A between the curved roll barrel section R(x) and the remaining, cylindrical roll barrel section Z is located exactly in the center of the roll barrel length L for the intermediate rolls 20, 21 illustrated here, i.e., it is located at x=L/2 (x is calculated from the cylindrical end of the barrel), which means that the intermediate rolls 20, 21 are suitable mainly for combatting parabolic ($x^2$) flatness defects.

Figure 2:
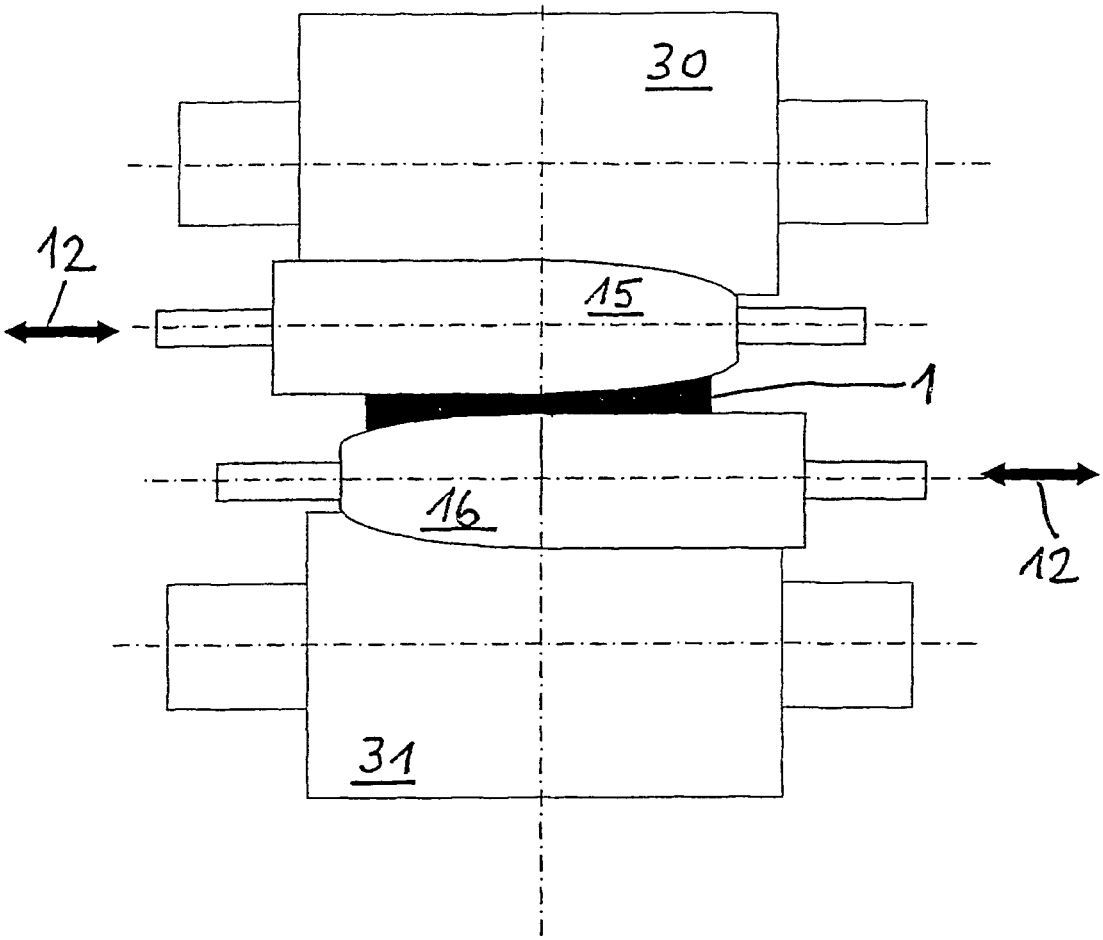
FIG. 2 shows the rolls of a four-high stand with work rolls shaped in accordance with the invention.

FIG. 2 illustrates the alternative application of the invention to work rolls 15, 16 shaped in accordance with the invention in a four-high stand for producing rolled strip 1 with work rolls 15, 16 and backup rolls 30, 31. While the cylindrical backup rolls 30, 31 in this case are also mounted so that they cannot be axially shifted, the work rolls 15, 16, which are shaped as convex rolls, can be axially shifted in arrow direction 12. Compared to the design of the work rolls 10, 11 of the six-high stand of FIG. 1, it is readily apparent that the shaping of the work rolls 15, 16 in the form of convex rolls results in much thicker rolls.

Figure 3:
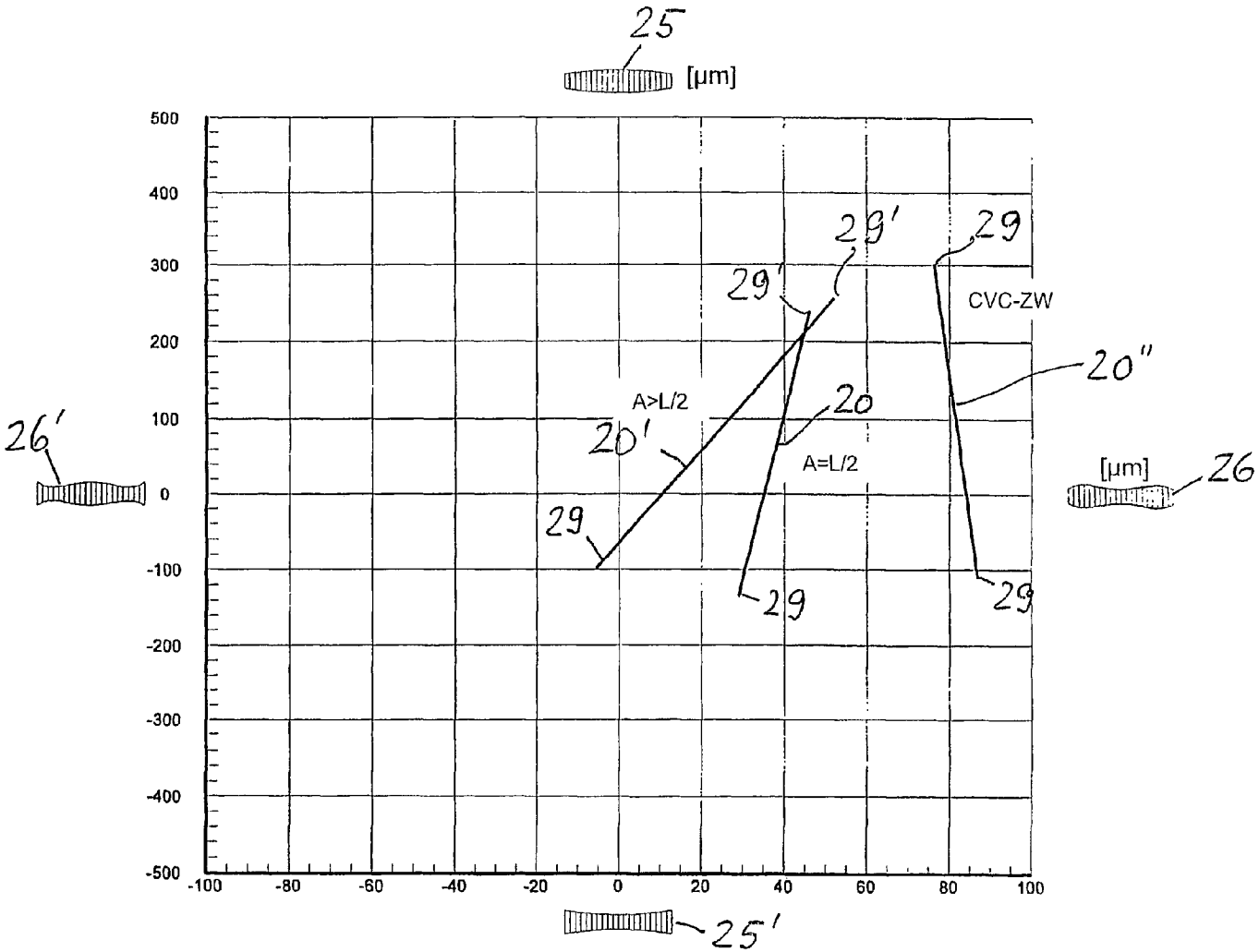
FIG. 3 shows adjustable roll gap profiles for a six-high rolling stand.

In FIG. 3, the possible roll gap profiles that can be adjusted for a six-high rolling stand with small work rolls are plotted on a coordinate system for two different intermediate rolls with convexly curved roll barrel sections and a conventional CVC intermediate roll for the entire shift range but a constant intermediate roll bending value. The diagram contains the quadratic influencing of the roll gap on the vertical scale, indicated by the symbols 25 for positive changes and 25' for negative changes. The nonquadratic changes are indicated on the horizontal scale by the symbols 26 for positive changes and 26' for negative changes. To make clear the effect that can be achieved, the horizontal scale is shown greatly enlarged relative to the vertical scale.

As can be seen from the coordinate system, a mainly quadratic effect on the profile is obtained in the case of an intermediate roll 20 with a transition point from the cylindrical to the curved roll barrel section of A=L/2 when it is shifted between the maximum shift position 29 and the minimum shift position 29'. In the case of an intermediate roll 20' with a transition point of A>L/2, an effect on the profile in the range of $x^4$ is clearly apparent when it is similarly shifted between the two possible shift positions 29 and 29'. The effect on the profile for a conventional CVC intermediate roll 20" is shown for comparison. Here again, a mainly quadratic effect is observed when the roll is shifted within the possible limits 29 and 29'.

Figure 4:
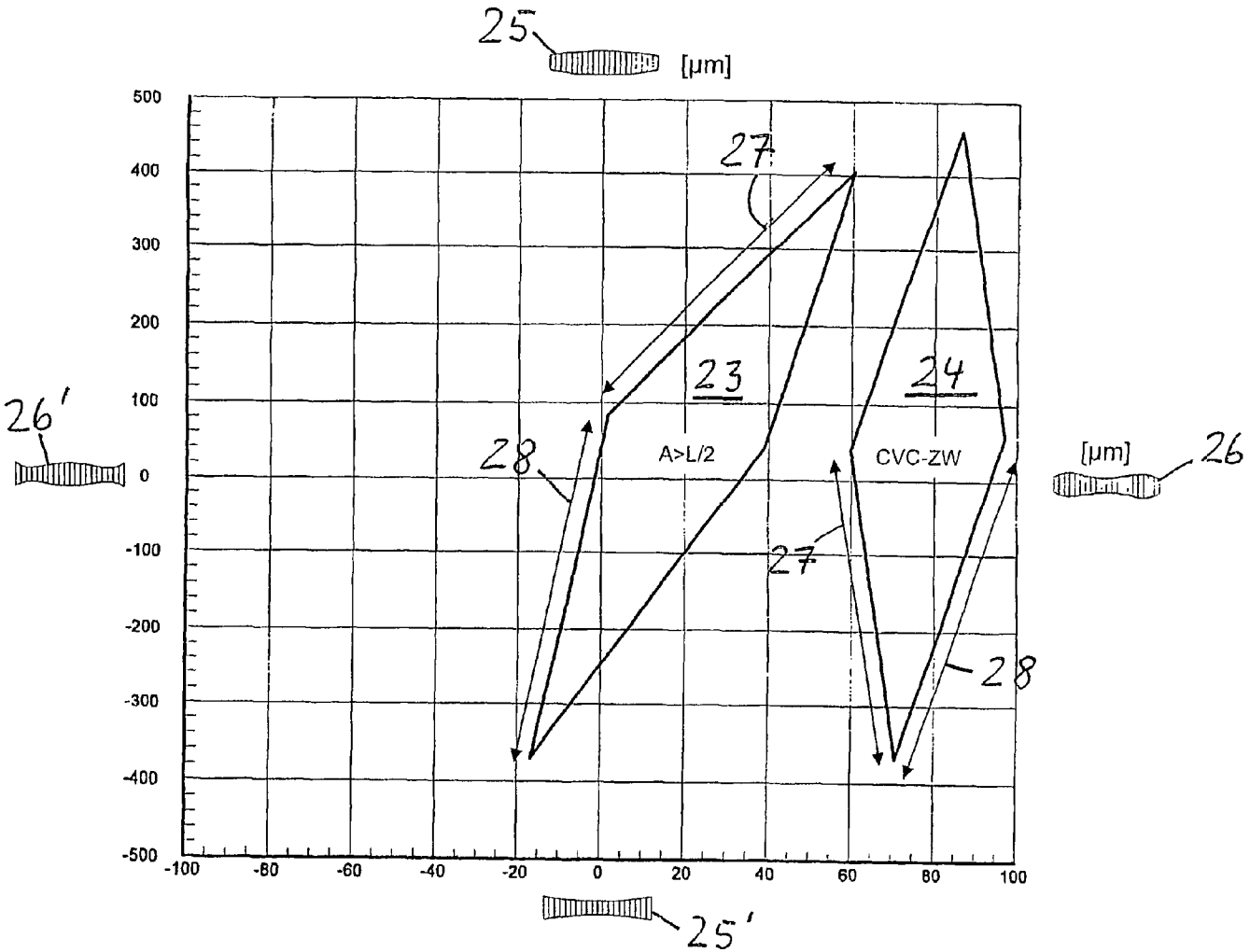
FIG. 4 shows adjustment fields based on the six-high rolling stand of FIG. 3.

The same coordinate system used in FIG. 3 is used in FIG. 4 to plot the possible roll gap profiles obtained for the intermediate roll 20 of the invention and for the conventional CVC intermediate roll 20" in the case of variable intermediate roll bending in addition to intermediate roll shifting. Based on the six-high rolling stand of FIG. 3, we now obtain the adjustment field 23 for the intermediate roll 20 of the invention and the adjustment field 24 for the CVC intermediate roll 20". The adjustment field 24 of the CVC intermediate roll 20" makes it clear that a residual defect $x^4$ always occurs at the origin of the coordinate system (rectangular profile).

Figure 5:
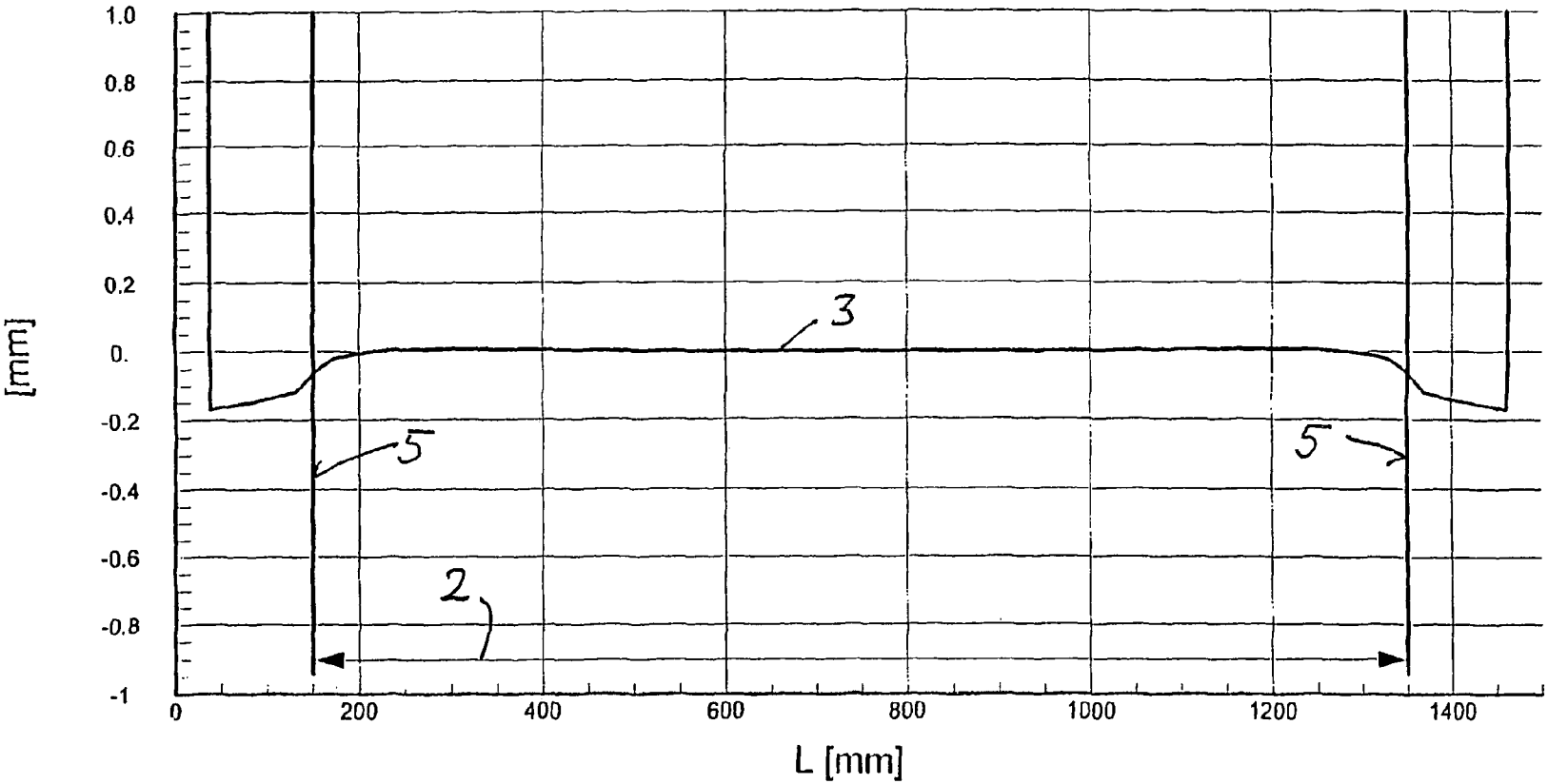
FIG. 5 shows a roll gap profile for the six-high stand of FIG. 3 with work rolls shaped in accordance with the invention.

FIG. 5 shows an example of a roll gap profile 3 that can be realized for the six-high rolling stand of FIG. 3 with intermediate rolls shaped in accordance with the invention when the intermediate roll bending and intermediate roll shifting are adjusted to optimum values. The diagram shows the course of the roll gap profile 3 over the entire roll barrel length L and the position of the strip width 2. The diagram clearly shows that the roll gap profile 3 deviates from a linear horizontal course only in the vicinity of the strip edges 5.

Figure 6:
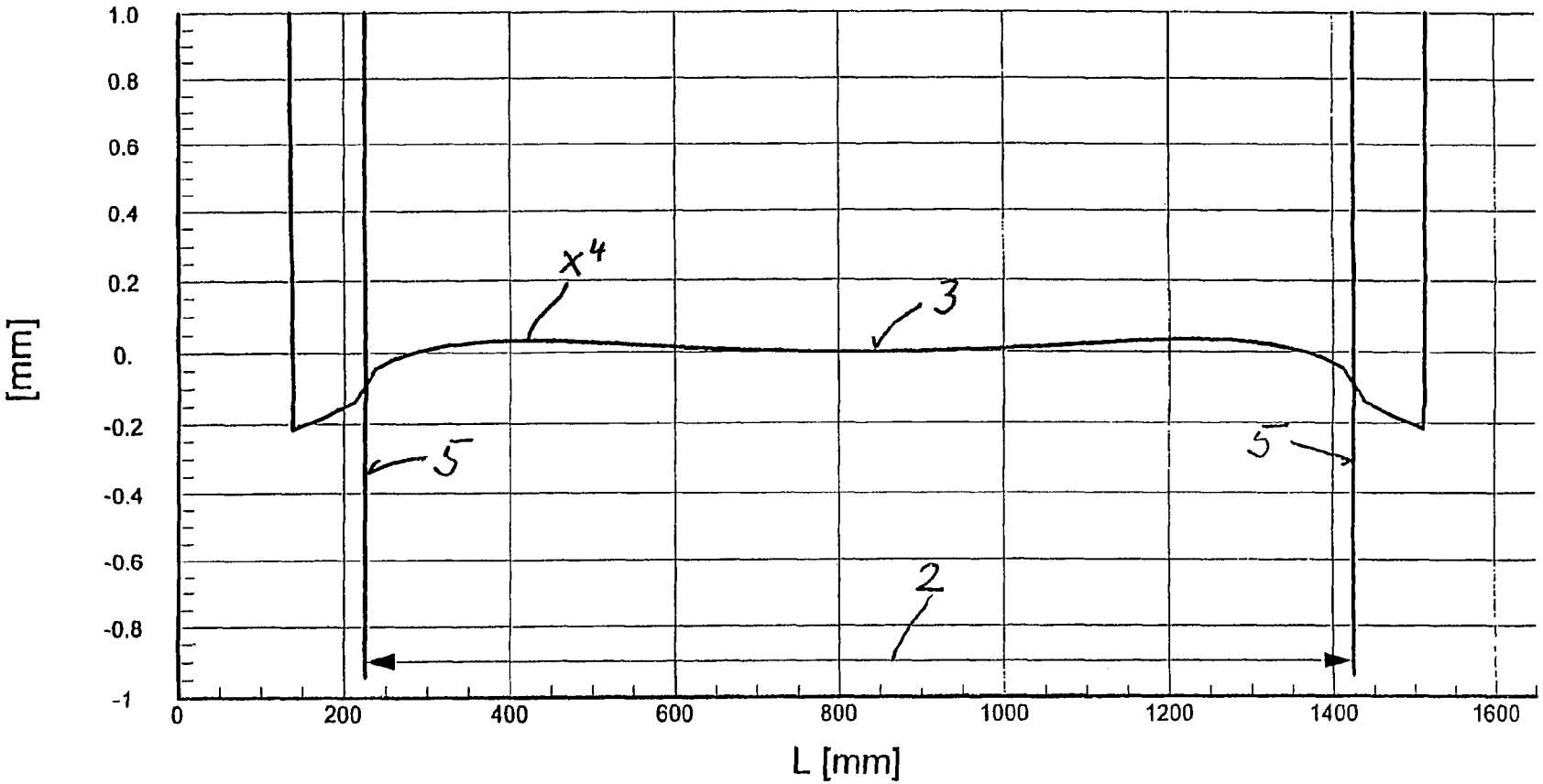
FIG. 6 shows a roll gap profile for the six-high stand of FIG. 3 with conventional CVC work rolls.

As FIG. 6 shows, when conventionally shaped CVC intermediate rolls are used in the same six-high rolling stand of FIG. 3, an $x^4$ residual defect that deviates from a linear horizontal course remains in the roll gap profile. The same residual defect is also apparent in FIG. 4.

Figure 7:
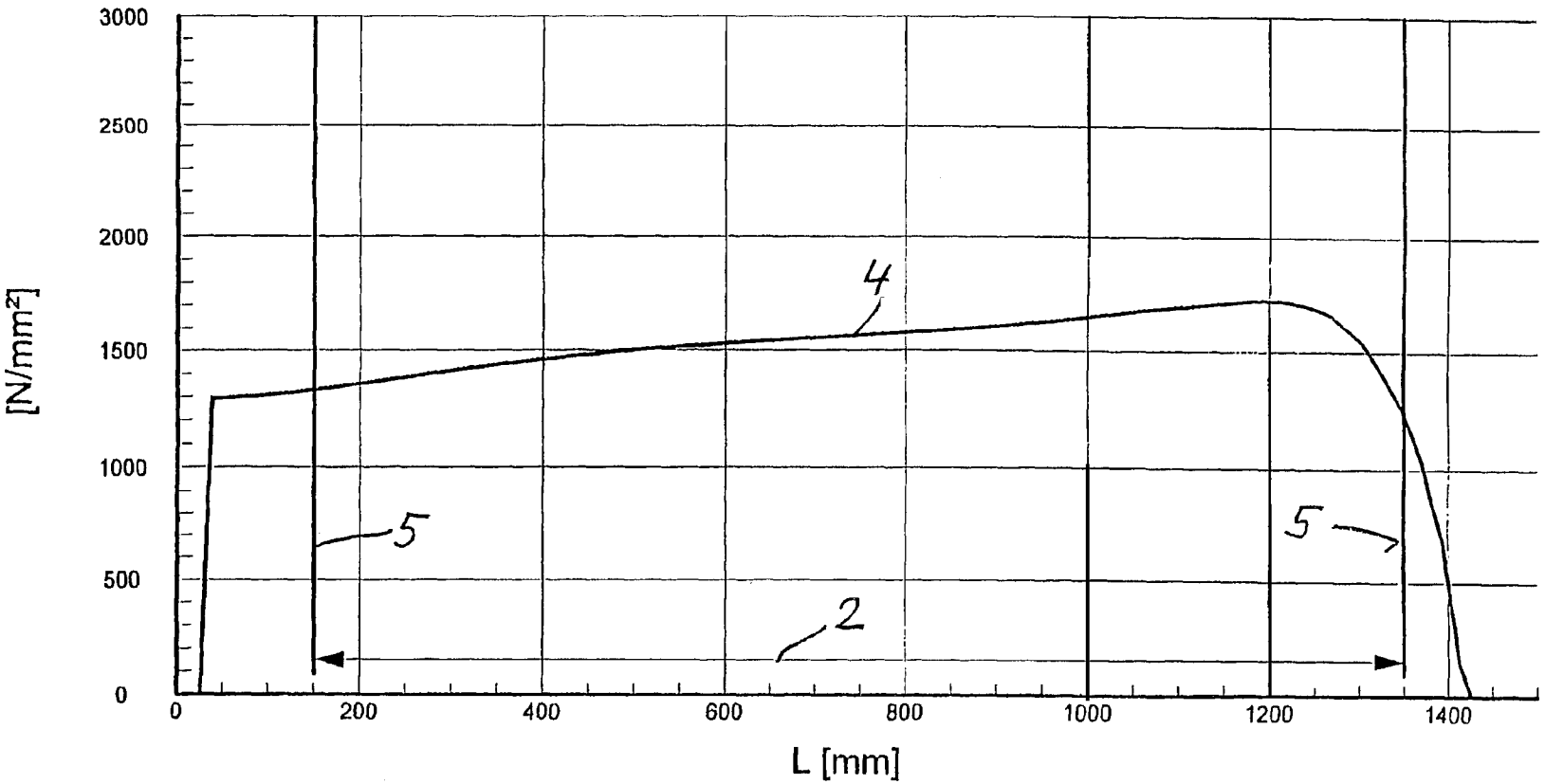
FIG. 7 shows the pressure distribution between the intermediate roll and the backup roll for the roll gap profile of FIG. 5.

In addition to the good results of the convex rolls with the horizontal course of the roll gap profile shown in FIG. 5, the pressure distribution 4 between the intermediate roll and the backup roll is also more favorable from the standpoint of wear, as is apparent from FIG. 7.

Figure 8:
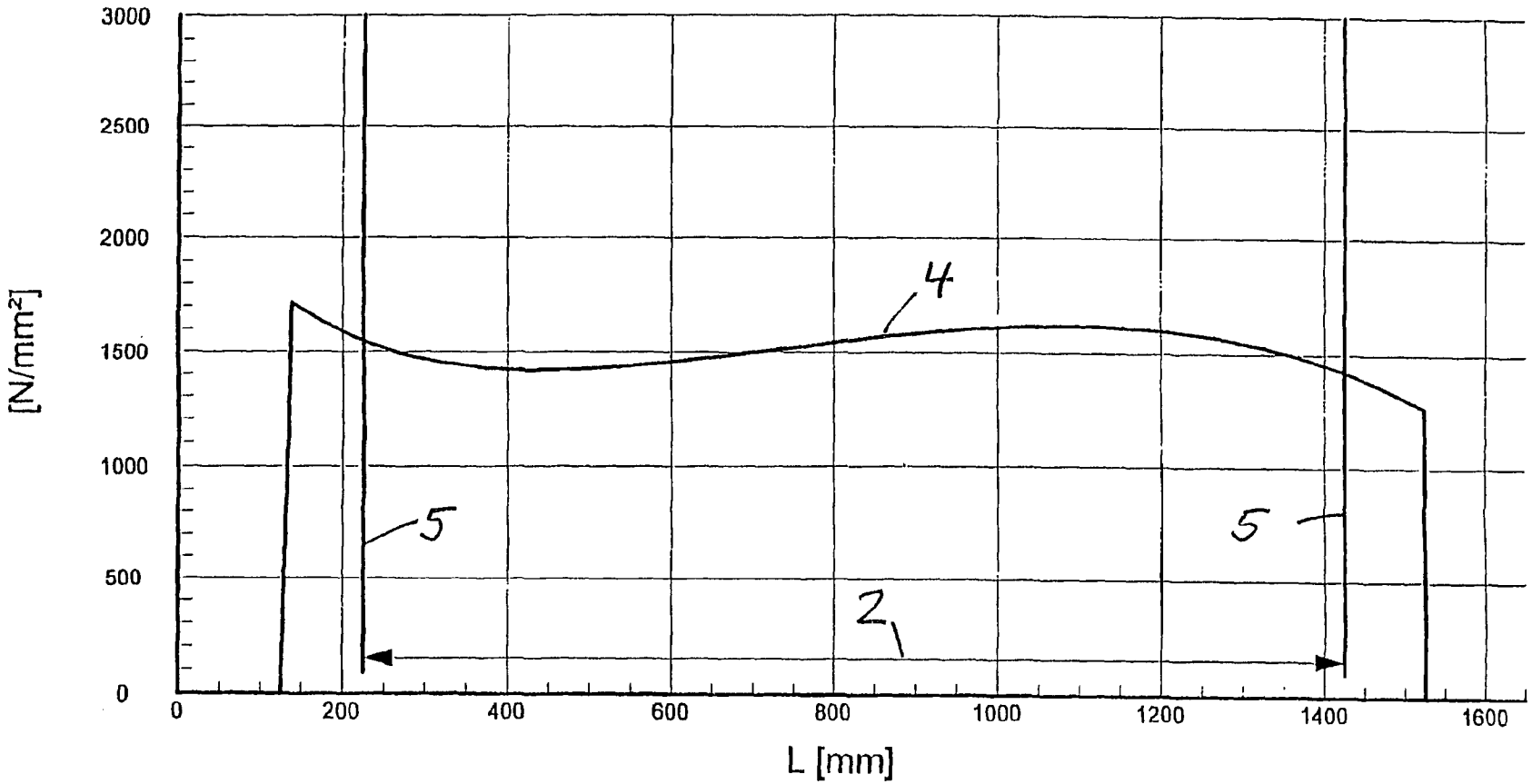
FIG. 8 shows the pressure distribution between the intermediate roll and the backup roll for the roll gap profile of FIG. 6.

A comparison with CVC rolls, which, with the roll gap profile of FIG. 6, produce a pressure distribution 4 between the intermediate roll and the backup roll according to FIG. 8, makes is clear that when convex rolls are used, more uniform and even diffusion of stress is obtained, and the roll service life for the convex rolls is thus increased accordingly.

LIST OF REFERENCE SYMBOLS

1 rolled strip
2 rolled strip width
3 roll gap profile
4 pressure distribution
5 strip edges
10, 11 cylindrical work roll
12 shift direction of the work roll
15, 16 work roll in accordance with the invention
20, 20', 21 intermediate roll
20" CVC intermediate roll
22 shift direction of the intermediate roll
23, 24 adjustment field
25, 25' quadratic component
26, 26' nonquadratic component
27 intermediate roll shifting
28 intermediate roll bending
29 maximum shift position
29' minimum shift position
30, 31 backup roll
A transition point between the curved and cylindrical roll barrel section
L roll barrel length
R(x) convex roll barrel section
x running direction for determining the position of the transition point A from the cylindrical end of the roll barrel
Z cylindrical roll barrel section

The invention claimed is:

1. Rolling stand for producing rolled strip (1), which consists of work rolls (10, 11, 15, 16), which are supported on backup rolls (30, 31) or on intermediate rolls (20, 21) and backup rolls (30, 31), wherein the work rolls (10, 11, 15, 16) and/or the backup rolls (30, 31) and/or the intermediate rolls (20, 21) are axially shiftable relative to one another, wherein a barrel length (L) of each intermediate roll (20, 21) in a six-high rolling stand or of each work roll (15, 16) in a four-high rolling stand consists of a cylindrical roll barrel section (Z) and a convexly curved roll barrel section (R(x)), such that a transition point (A) from the cylindrical to the curved roll barrel section, calculated from the cylindrical end of the roll barrel, is selected in the range of $L/2 \leqq x < L$, where x is a distance from a cylindrical end of the roll barrel, and the curved contour, which extends towards opposite ends of the two rolls (15, 16, 20, 21) over a portion of the width of the rolling stock in the direction of the end of the barrel, is described by a mathematical polynomial $R(x)=a_o+\ldots a_n x^n$, where $n \geqq 5$, where a is a constant.

2. Rolling stand in accordance with claim 1, including work rolls and intermediate rolls, wherein the work rolls and intermediate rolls (15, 16, 20, 21), which are provided with a convexly curved roll barrel section (R(x)) and are referred to as convex rolls, are designed with a roll diameter that is so large that bending forces have an essentially parabolic ($X^2$) effect on the roll gap profile (3).

3. Rolling stand in accordance with claim 1, wherein, to compensate and prevent predominantly parabolic ($X^2$) flatness defects, the transition point (A) is set to a value of $x=L/2$.

4. Rolling stand in accordance with claim 1, wherein, to compensate and prevent predominantly defects of higher order, the transition point (A) is set to a value of $x \geqq L/2$.

5. Rolling stand in accordance with claim 1, wherein, other rolls of the rolling stand besides the rolls (15, 16, 20, 21) that are provided with a convexly curved roll barrel section (R(x)) are designed with a roll barrel that is cylindrical over its entire length.

6. Rolling stand in accordance with claim 4, wherein the transition point (A) is set to a value to compensate and prevent defects of $x^4$ and higher.

* * * * *